US012071759B2

(12) United States Patent
Tuell

(10) Patent No.: US 12,071,759 B2
(45) Date of Patent: Aug. 27, 2024

(54) SYSTEM AND METHOD FOR SEALING AN ANNULAR SPACE OF A SEWER CONNECTION LINE

(71) Applicant: Gulf Coast Underground, LLC, Theodore, AL (US)

(72) Inventor: Spencer Tuell, Theodore, AL (US)

(73) Assignee: Gulf Coast Underground, LLC, Theodore, AL (US)

( * ) Notice: Subject to any disclaimer, the term of this patent is extended or adjusted under 35 U.S.C. 154(b) by 0 days.

(21) Appl. No.: 18/125,865

(22) Filed: Mar. 24, 2023

(65) Prior Publication Data

US 2023/0295914 A1 Sep. 21, 2023

Related U.S. Application Data

(63) Continuation of application No. 17/565,163, filed on Dec. 29, 2021, now Pat. No. 11,643,801.

(51) Int. Cl.

| | |
|---|---|
| ***E03F 3/00*** | (2006.01) |
| ***E03F 3/04*** | (2006.01) |
| ***E03F 3/06*** | (2006.01) |
| ***E03F 7/12*** | (2006.01) |

(52) U.S. Cl.
CPC ..... *E03F 3/06* (2013.01); *E03F 3/04* (2013.01); *E03F 7/12* (2013.01); *E03F 2003/065* (2013.01)

(58) Field of Classification Search
CPC ..... E02F 2003/065; E03F 3/06; E03F 3/04; E03F 7/12; F16L 55/1652; F16L 55/1653; F16L 55/1654; F16L 55/1645; F16L 55/163; F16L 55/179
See application file for complete search history.

(56) References Cited

U.S. PATENT DOCUMENTS

| | | | | |
|---|---|---|---|---|
| 5,465,758 | A * | 11/1995 | Graf | F16L 55/163 405/150.1 |
| 8,453,413 | B2 * | 6/2013 | Matiere | E04B 5/40 405/184.2 |
| 10,808,876 | B2 * | 10/2020 | Gunnarsson | E21B 17/00 |
| 2019/0107241 | A1 * | 4/2019 | Kiest, Jr. | E02D 29/128 |

* cited by examiner

*Primary Examiner* — Benjamin F Fiorello
(74) *Attorney, Agent, or Firm* — AdamsIP, LLC; Edward B. Garner, III; J. Hunter Adams

(57) ABSTRACT

A system and method for reducing the amount of infiltrate entering a sewer system is provided. The system generally comprises a locking sleeve, hydrophilic gasket, and a locking mechanism, wherein a lateral porthole of said locking sleeve is surrounded by said hydrophilic gasket. The system is preferably installed at a lateral line connection point, wherein a hydrophilic gasket located around the lateral porthole creates the water barrier that prevents infiltrate from entering a newly refurbished host pipe through the hole cut to reestablish flow from the lateral line to the host pipe at the lateral line connection point.

20 Claims, 6 Drawing Sheets

SYSTEM AND METHOD FOR SEALING AN ANNULAR SPACE OF A SEWER CONNECTION LINE

FIELD OF THE DISCLOSURE

The subject matter of the present disclosure refers generally to a process for sealing the point at which a lateral sewer line connects to the main sewer line during the rehabilitation of the main sewer line.

BACKGROUND

Partial or complete plumbing pipe replacement can be incredibly expensive. A cost-effective method for replacing damaged pipes is cured in place pipe lining (CIPP), which is just as durable as replacement pipes when installed properly. However, when CIPP liners are used to refurbish damaged main sewer lines, the cured in place pipe liner does not bond to the old pipes. This process typically involves inserting a liquid epoxy resin impregnated liner into the main sewer line and then inflating it via air or water pressure. The liner presses the liquid resin impregnated liner against the interior walls of the old pipe to ensure the new cured in place pipe lining is as close to the size of the old pipe as possible. The liquid resin is then cured in order to harden the liner, resulting in a refurbished pipe that should last for a number of years.

Unfortunately, CIPP liners often shrink during the curing process, reducing the quality of the seal between the CIPP liner and old pipes. This shrinkage of the CIPP liner creates an annular space between the CIPP liner and the old pipe that infiltrate can travel through until it enters the sewer system at the point in which the lateral line enters the new CIPP liner. This infiltrate can create multiple problems ranging from overflow of the sewer system to a reduction of the effectiveness of municipal wastewater treatment facilities. In areas with high rainfall, infiltration of the groundwater into the sewer mainline can be especially bad as the water seeps into the annular space between the old pipes and CIPP liner and makes its way into the mainline. This results in diluted wastewater, which can negatively affect the ability to treat said wastewater at wastewater treatment facilities. When rainfall is particularly heavy in these areas, sanitary sewer overflows create a number of environmental issues that may result in hefty fines from the Environmental Protection Agency if the cause of the overflow is not properly addressed. Additionally, overflows can result in contaminated drinking water in some areas, potentially making this issue a public health hazard as well.

Accordingly, there is a need in the art for an improved process for installing CIPP liners that may reduce or eliminate the amount of infiltrate entering the sewer system.

SUMMARY

A system and method for reducing the amount of infiltrate entering a sewer system is provided. In one aspect, the invention prevents infiltrate from entering the wastewater management system by blocking the annular space around the point at which a lateral line connects to a main sewer line. In another aspect, the invention pertains to the manner in which an annular space sealing apparatus is installed within a main sewer line prior to refurbishment of said main sewer line. Generally, the system of the present disclosure is designed to create water barriers between itself, the host pipe, and a new pipe installed using a cured in place pipe (CIPP) technique. The system is preferably installed around a lateral line connection point and generally comprises a locking sleeve having a locking mechanism and lateral porthole, wherein a hydrophilic gasket located around the lateral porthole creates the water barrier that prevents infiltrate from entering a newly lined pipe through the hole cut to reestablish flow from the lateral line to the wastewater treatment system at the lateral line connection points.

The locking sleeve is preferably configured to secure the annular space sealing apparatus to the interior of a host pipe. The locking sleeve comprises a coiled wall and a locking mechanism secured to the interior surface of said coiled wall, wherein said interior surface is within a cavity created by said coiled wall. The locking mechanism comprises at least two slotted straps and at least two locking gears that are secured to the interior surface of the coiled wall. The at least two locking gears are configured to follow the at least two slotted grooves from a first point to a second point, which cause the diameter of the coiled wall to expand. Because the diameter of the locking sleeve is designed to expand, the diameter of the coiled wall is smaller than the diameter of the host pipe prior to installation to make installation easier. Once expanded, the locking mechanism prevents the coiled wall from decreasing in diameter.

Once the annular space sealing apparatus is placed in position within the host pipe at the lateral line connection point, a resin impregnated liner may be installed within said host pipe. The resin impregnated liner comprises a felt tube and a curable material, wherein said curable material hardens after undergoing a curing process. Two methods are preferably used to install the liner within the host pipe: Pull Through and Inversion. The pull through method involves threading the resin impregnated liner through the host pipe from an upstream access point to a downstream access point and then curing it. The inversion technique involves inserting a rolled resin impregnated liner through the host pipe using water, air, or steam and then curing it. By placing the annular space sealing apparatus at various lateral line connection points throughout the host pipe, the amount of infiltrate entering the wastewater management system will be reduced due to the hydrophilic gasket absorbing the water and expanding, which creates a water barrier around the hole cut into the newly lined pipe when reestablishing flow from the lateral lines.

The foregoing summary has outlined some features of the process of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and process disclosed herein. Those skilled in the pertinent art should also realize that such equivalent designs or modifications do not depart from the scope of the process of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

Figure 1:
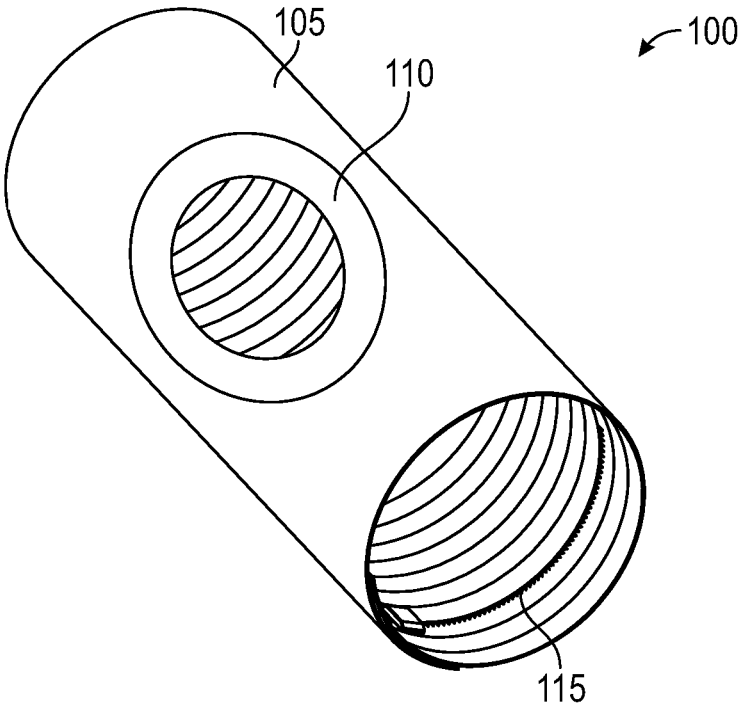
FIG. 1 is a diagram illustrating a system embodying features consistent with the principles of the present disclosure.

In the Summary above and in this Detailed Description, and the claims below, and in the accompanying drawings, reference is made to particular features, including process steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally. Where reference is made herein to a process comprising two or more defined steps, the defined steps can be carried out in any order or simultaneously (except where the context excludes that possibility), and the process can include one or more other steps which are carried out before any of the defined steps, between two of the defined steps, or after all the defined steps (except where the context excludes that possibility).

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components. As used herein, the term "lateral lines" and grammatical equivalents thereof may refer to pipes that carry wastewater from residential areas and businesses. For instance, lateral lines running from residential households may connect the residential households to the main sewer line so that wastewater may be transferred from the residential households to the local wastewater treatment facility. As used herein, the term "main sewer line" and grammatical equivalents thereof may refer to large pipes or open channels that collect the wastewater from the lateral lines and transfer said wastewater to lift stations, force mains, etc. For instance, an underground main sewer line may collect wastewater from a plurality of lateral lines within a neighborhood so that it may be transferred to a local wastewater treatment facility.

As used herein, the term "access point" and grammatical equivalents thereof may refer to an entry port that allows for inspection of and repair of lateral lines. As used herein, the term "connection point" and grammatical equivalents thereof may refer to the point at which a lateral line connects to a main sewer line. For instance, a user may use an access point to inspect and repair a main sewer line in order to inspect and repair said main sewer line. As used herein, the term "infiltrate" and grammatical equivalents thereof may refer to groundwater that enters the wastewater management system via cracks, leaky pipe joints, connection failures, deteriorated manhole covers, etc. For instance, a damaged main sewer line buried in a region with a high water table may receive ground water that dilutes wastewater of the wastewater treatment system of which the main sewer line is a part of and causes overflows of wastewater into the surrounding area.

Figure 2:
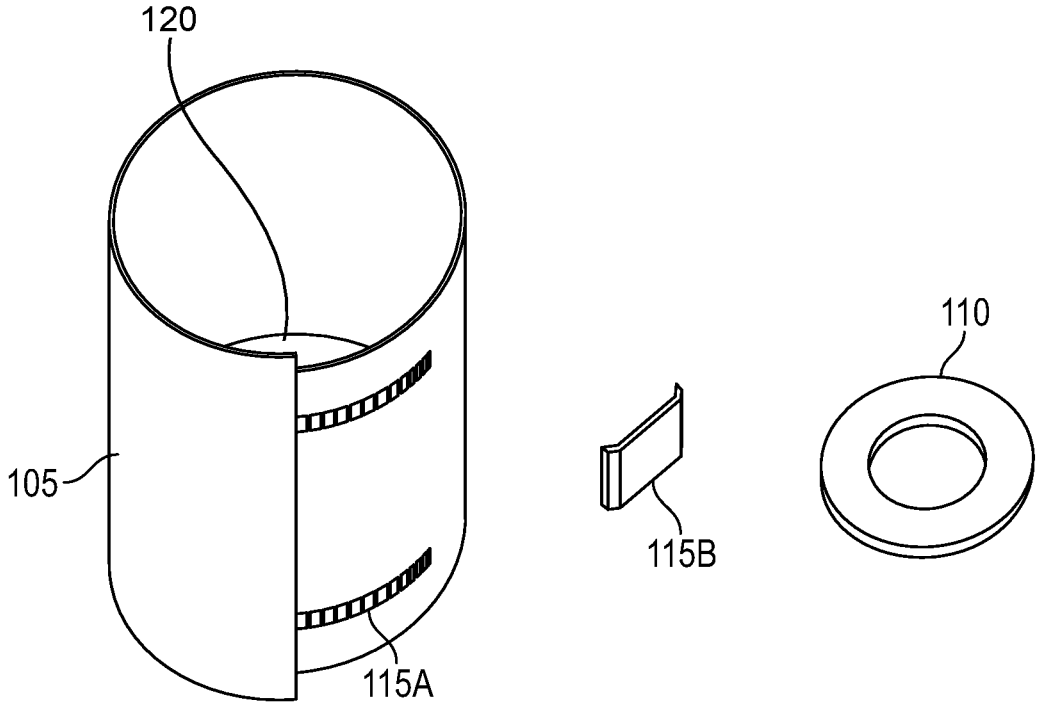
FIG. 2 is a diagram illustrating a system embodying features consistent with the principles of the present disclosure.
Figure 3:
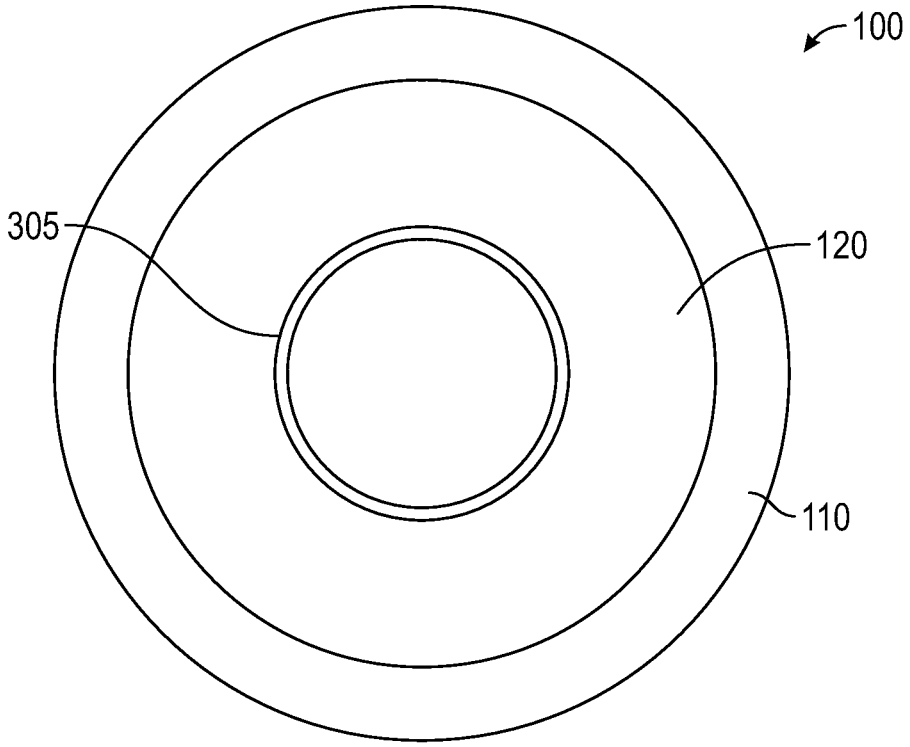
FIG. 3 is a diagram illustrating a system embodying features consistent with the principles of the present disclosure.
Figure 4:
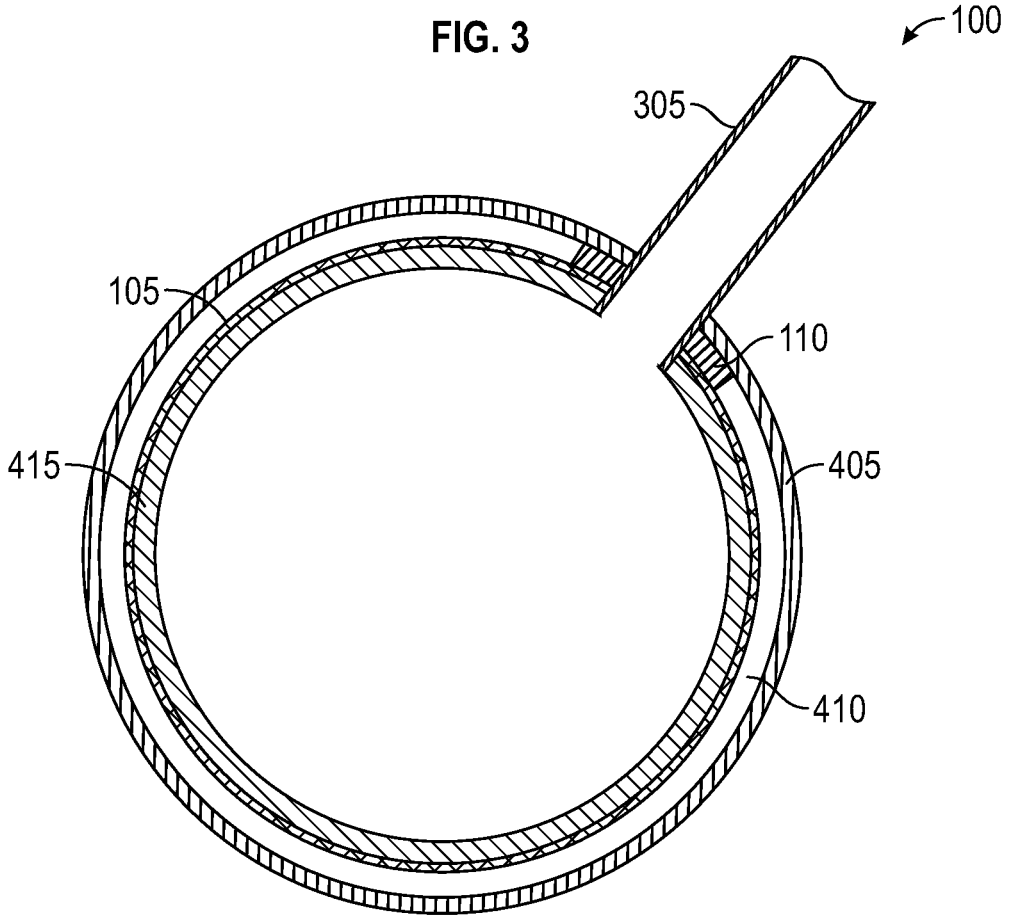
FIG. 4 is a diagram illustrating a system embodying features consistent with the principles of the present disclosure.
Figure 5:
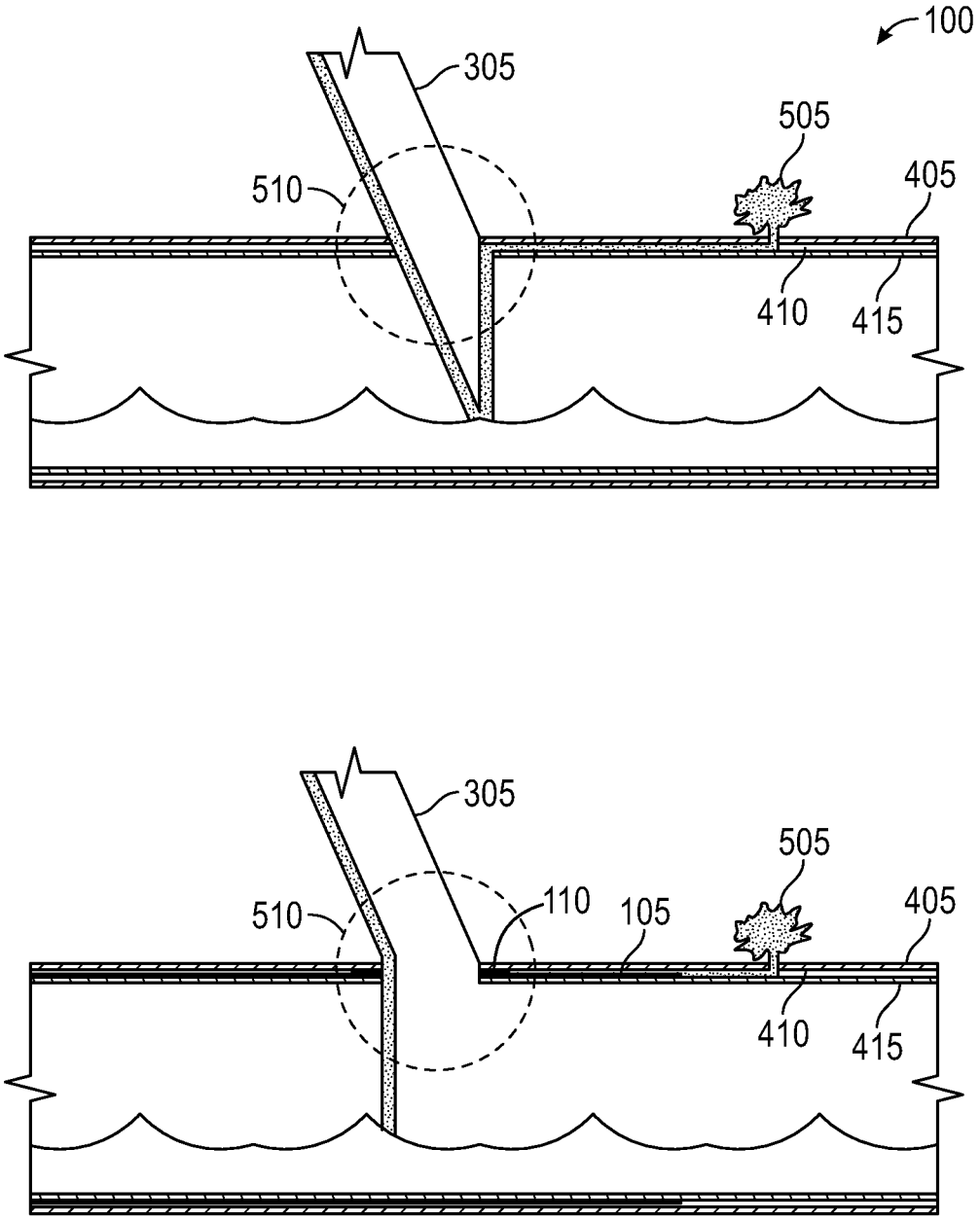
FIG. 5 is a diagram illustrating a system embodying features consistent with the principles of the present disclosure.
Figure 6A:
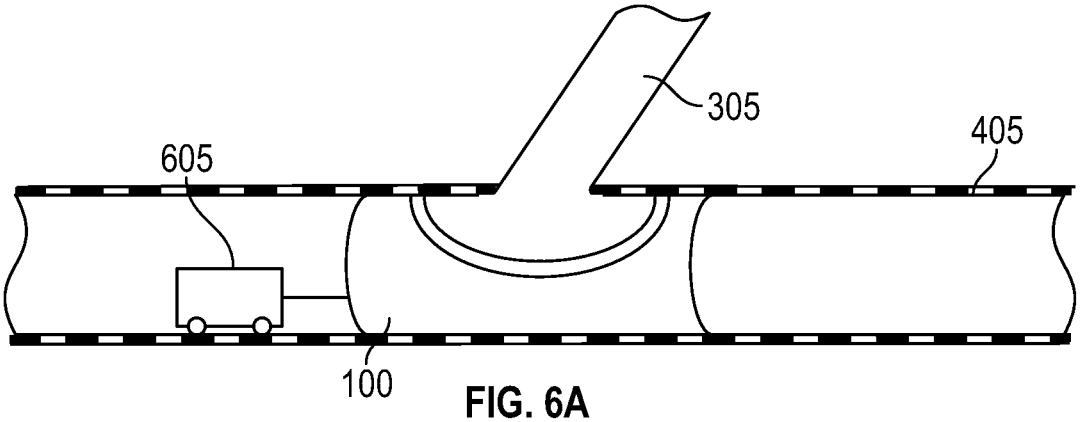
FIG. 6A is a diagram illustrating a system being installed by a plumbing pipe inspection crawler at a lateral line connection point prior to installation of a cured in place pipe.
Figure 6B:
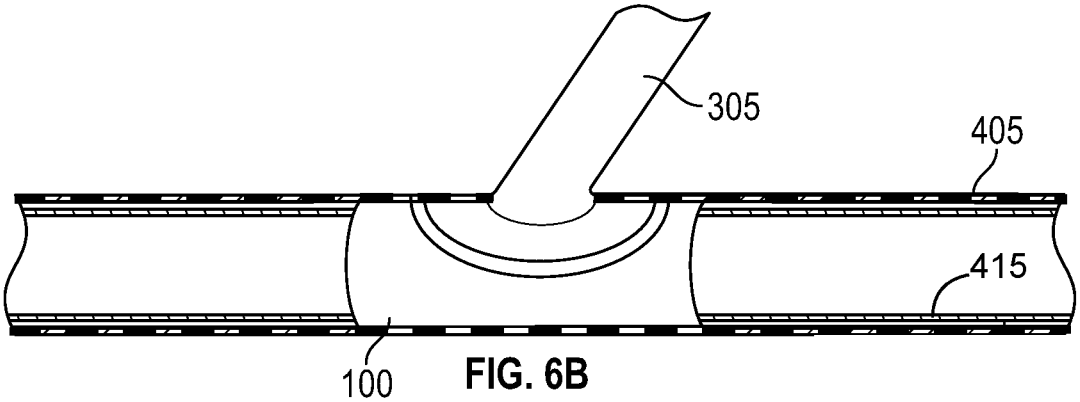
FIG. 6B is a diagram illustrating a cured in place pipe being installed after installation of the system at the lateral line connection point.
Figure 6C:
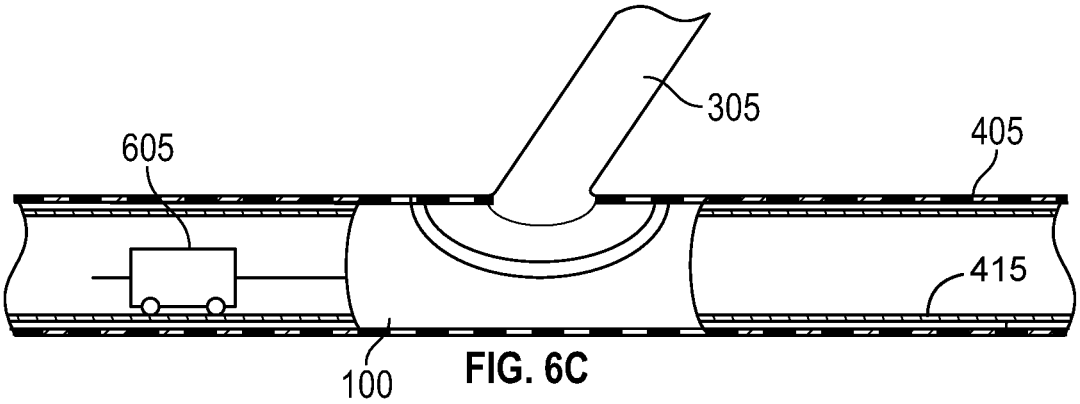
FIG. 6C is a diagram illustrating a plumbing pipe inspection crawler reestablishing flow from a lateral line to a main sewer line after installation of the system and a cured in place pipe.
Figure 6D:
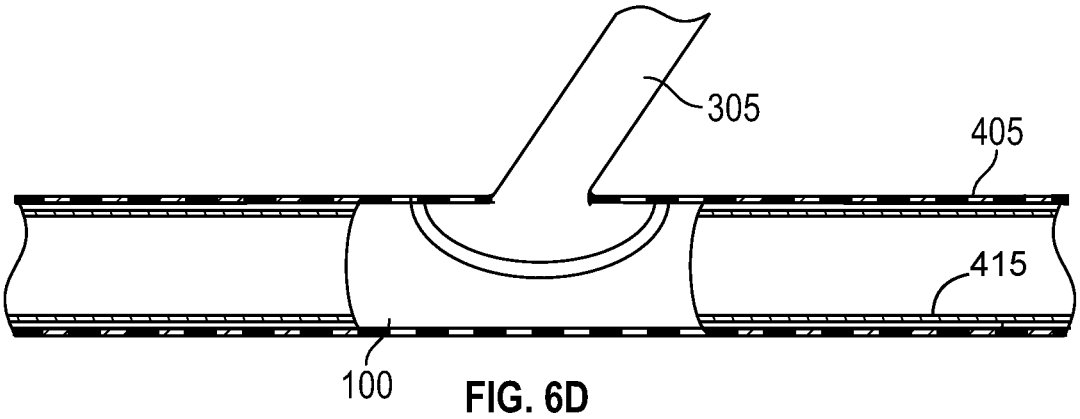
FIG. 6D is a diagram illustrating a main sewer line that has been refurbished using the system and a cured in place pipe.
Figure 7:
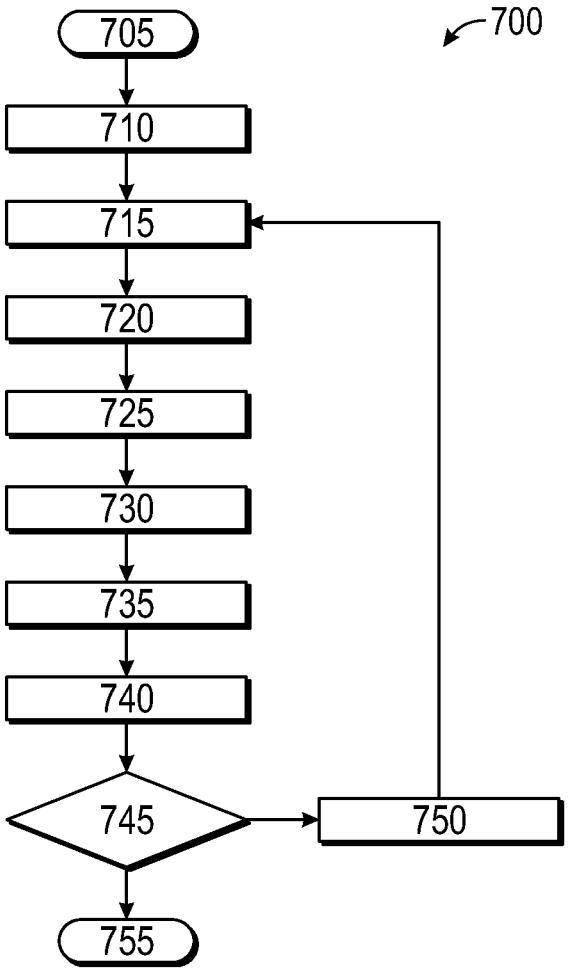
FIG. 7 is a flow chart illustrating certain method steps of a method embodying features consistent with the principles of the present disclosure.
Figure 8:
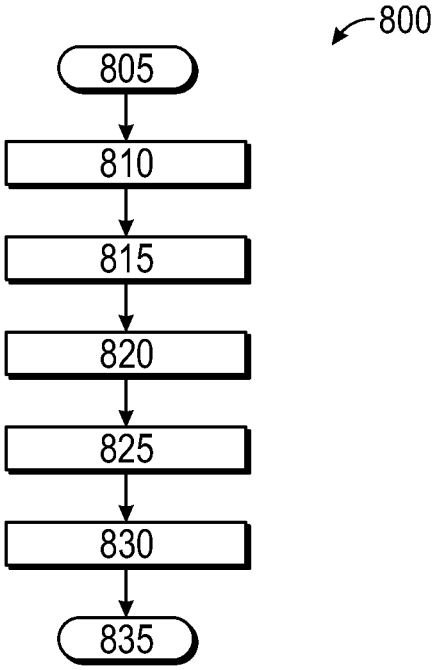
FIG. 8 is a flow chart illustrating certain method steps of a method embodying features consistent with the principles of the present disclosure.

FIGS. 1-8 illustrate embodiments of an annular space sealing apparatus 100 and methods for connecting said annular space sealing apparatus 100 to a main line. FIG. 1 is a top perspective view of an annular space sealing apparatus 100, wherein the annular space sealing apparatus 100 is configured to be secured within a mainline of a sewer system. FIG. 2 is an exploded view of an annular space sealing apparatus 100. FIG. 3 is a perspective view of the lateral porthole 105B of the annular space sealing apparatus 100. FIG. 4 is a cross sectional view of an annular space sealing apparatus 100 used in combination with a resin impregnated liner 415 at a lateral line connection point 510 to prevent infiltrate 505 from entering a sewer system. FIG. 5 is an illustration of a refurbished sewer system with and without the use of a later line connection apparatus 100. FIG. 6A-D illustrates the manner in which the annular space sealing apparatus is installed with a cured in place pipe liner. FIGS. 7 and 8 illustrate various methods that may be carried out by a user using the system described herein. It is understood that the various method steps associated with the methods of the present disclosure may be carried out by a user using the systems shown in FIGS. 1-6D.

As illustrated in FIGS. 1-6D, the annular space sealing apparatus 100 comprises a locking sleeve 105, hydrophilic gasket 110, and a locking mechanism 115, wherein a lateral porthole 105B of said locking sleeve 105 is surrounded by said hydrophilic gasket 110. The hydrophilic gasket 110 is preferably located on an exterior surface of the locking sleeve 105 in order to create a watertight seal between the locking sleeve 105, cured-in-place pipeline, and the host pipe 405 but some preferred embodiments may also comprise a hydrophilic gasket 110 surrounding the lateral porthole 105B about the interior surface of the locking sleeve 105. The hydrophilic gasket 110 preferably creates a continuous seal about the entire circumference of the lateral porthole 105B. The hydrophilic gasket 110 may be any shape so long as it surrounds the lateral porthole 105B, but in a preferred embodiment, the hydrophilic gasket 110 is the shape of a ring with the thickness of the ring being at least two inches and the internal diameter of the ring being at least four inches larger than the diameter of the lateral porthole 105B, as illustrated in FIG. 3.

As illustrated in FIGS. 1 and 2, the locking sleeve 105 comprises a coiled wall 105A having a lateral porthole 105B that is configured in a way that allows the annular space sealing apparatus 100 to be secured to the interior of a main sewer line. The material in which the coiled wall 105A of the locking sleeve 105 is comprised is preferably a metal having malleable properties, such as soft stainless steel sheet metal or aluminum. The shape of the locking sleeve 105 is preferably round and can increase in diameter via manipulation by a user. The locking mechanism 115 is secured to and/or part of the interior surface of said coiled wall 105A, wherein said interior surface is within a cavity created by said coiled wall 105A, as illustrated in FIG. 1. The locking mechanism 115 comprises at least two slotted grooves 115A and at least two locking gears 115B that are secured to the interior surface of the coiled wall 105A. The at least two locking gears 115B are configured to follow the at least two slotted grooves 115A from a first point to a second point, causing the diameter of the coiled wall 105A to expand. In a preferred embodiment, internal pressure asserted against the interior surface of the coiled wall 105A causes the coiled wall 105A to increase its diameter by forcing the at least two locking gears 115B from a first point to a second point about the slotted grooves 115A. As the diameter of the coiled wall 105A expands, the hydrophilic gasket 110 located on the exterior surface of the coiled wall 105A contacts the interior surface of the main sewer line, creating a watertight barrier therebetween.

In one preferred embodiment, the annular space sealing apparatus 100 may be designated for a specific diameter range. For instance, an annular space sealing apparatus 100 may be configured to fit a host pipe 405 having a diameter between 6 inches and 12 inches but may come in any diameter that fits a main sewer line. The at least two slotted grooves 115A may be of a length that allows the diameter of the coiled wall 105A to extend to the diameter of the host pipe 405. The diameter of the lateral porthole 105B is preferably four inches wider than the diameter of the lateral line 305 connecting to the host pipe. The larger diameter will make alignment of the lateral porthole 105B at the lateral line connection point 510 easier for a technician attempting to install the annular space sealing apparatus 100 within the host pipe 405 so that it does not block flow from the lateral line 305 into the new resin impregnated liner 415. Once the annular space sealing apparatus 100 is placed in position within the host pipe 405 at the lateral line connection point 510, the resin impregnated liner 415 may be installed within said host pipe 405. In a preferred embodiment, the resin impregnated liner 415 comprises a felt tube and a curable material, wherein said curable material hardens after undergoing a curing process. Materials that may be used to make the felt tube, include, but are not limited to, polyester, fiberglass cloth, spread tow carbon fiber, or another rother resin-impregnable substance. Materials that may be used as the curable material include, but are not limited to, epoxy, polyester and vinyl ester, and silicate resin. In a preferred embodiment two methods may be used to install the liner within the host pipe 405: Pull Through and Inversion.

The pull through method involves threading the resin impregnated liner 415 through the host pipe 405 from an upstream access point to a downstream access point or vice versa. Once the liner has been threaded through the host pipe 405, it is inflated. In some preferred embodiments, an air compressor inflates the liner. In another preferred embodiment, a bladder 315 is used to inflate the liner. In embodiments with a bladder 315, the internal bladder 315 located within an interior space of the liner may be inflated using a pump, which presses the resin impregnated liner 415 against the host pipe 405 so that it may be cured. In a preferred embodiment, the pump may inflate the bladder 315 with air, water, or steam, wherein the bladder 315 is made from a material such as silicon to prevent the adhesion of the bladder 315 to the resin impregnated liner 310 as said resin impregnated liner 415 cures. The bladder 315 is preferably inflated with a hot material to increase the rate at which the curable material cures. The bladder 315 remains inflated until the resin is cured and is then removed. The inversion technique involves inserting a rolled resin impregnated liner through the host pipe 405 using water, air, or steam. As the rolled liner is filled with air, it unrolls though the host pipe 405 from an upstream access point to a downstream access point. Once unrolled, the host pipe 405 is left filled with fluid until the curable material hardens; however, some embodiments may require that the bladder 315 inflate the resin impregnated liner 415 with a room temperature fluid so that a plumbing pipe inspection crawler 435 having UV lights secured thereto may be used to harden a curable material that is UV reactive.

As the resin impregnated liner 415 cures, an annular space 410 will form between the host pipe 405 and the cured resin impregnated liner 415. However, by installing the annular space sealing apparatus 100 about a lateral line connection point 510 of the main sewer line prior to installation of the resin impregnated liner 415, the amount of infiltrate 505 entering the wastewater management system 400 will be reduced or eliminated. As the annular space 410 fills with infiltrate 505, the hydrophilic gasket 110 will absorb the water and expand, creating a watertight barrier therebetween that prevents said infiltrate 505 from entering through the hole cut into the cured resin impregnated liner 415, which is cut to reestablish flow from the lateral line 305 to main sewer line. Because a plurality of annular space sealing apparatus 100 may need to be installed throughout the host pipe 405 prior to installation of the resin impregnated liner 415, a plurality of watertight barriers may be formed when refurbishing the host pipe 405. Additionally, each watertight barrier of the plurality of watertight barriers will provide additional friction as the watertight barrier expands between the host pipe 405 and the cured resin impregnated liner 415, reducing the likelihood of rotation of the annular space sealing apparatus 100 that might cause the lateral porthole 105B to become misaligned with the lateral line connection point 510.

FIG. 7 provides a flow chart 700 illustrating certain method steps that may be used to carry out the process of installing an annular space sealing apparatus 100 within a host pipe 405. Step 705 indicates the beginning of the method. During step 710, a user may obtain an annular space sealing apparatus 100 and a pipe inspection crawler 435 configured to install said annular space sealing apparatus 100. The user may then secure the annular space sealing apparatus 100 to the pipe inspection crawler 435 in a way such that the pipe inspection crawler 435 may increase the diameter of the annular space sealing apparatus 100 within the host pipe 405 during step 715. In a preferred embodiment, the pipe inspection crawler 435 may increase the diameter of the annular space sealing apparatus 100 using an inflatable bladder. Once secured thereto, the user may place the pipe inspection crawler 435 within the host pipe 405 during step 720 and subsequently proceed to control the pipe inspection crawler 435 until it reaches the point within the host pipe 405 that the user would like to secure the annular space sealing apparatus 100 thereto during step 725. In a preferred embodiment, the annular space sealing apparatus 100 is installed by the pipe inspection crawler 435 at the lateral line connection point 510.

The user may then operate the pipe inspection crawler 435 in way that causes the pipe inspection crawler 435 to increase the diameter of the annular space sealing apparatus 100 during step 730, wherein the diameter is increased until the hydrophilic gasket 110 is in contact with the inner surface of the host pipe 405 and around the lateral line connection point 510. Once the diameter of the annular space sealing apparatus 100 has been expanded, the user may disengage the pipe inspection crawler 435 from the annular space sealing apparatus 100 during step 735. Once disengaged the user must perform a query to determine whether an additional annular space sealing apparatus 100 must be installed within the host pipe 405 at a lateral line connection point 510 during step 740. Based on the results of the query, the user may take an action during step 745. If the user determines that an additional annular space sealing apparatus 100 must be installed within the host pipe 405, the user may retract the pipe inspection crawler 435 during step 750 and subsequently proceed to step 715. If the user determines that no additional annular space sealing apparatus 100 must be installed within the host pipe 405, the user may proceed to terminate method step 755.

FIG. 8 provides a flow chart 800 illustrating certain method steps that may be used to carry out the process of installing a resin impregnated liner 415 within a host pipe 405. Step 805 indicates the beginning of the method. During step 810, the user may install at least one annular space sealing apparatus 100 within the host pipe 405 in a way that will reduce the amount of infiltrate 505 that enters the wastewater management system. In a preferred embodiment, an annular space sealing apparatus 100 is installed at the lateral line connection point 510. The user may then obtain a resin impregnated liner 415, bladder 315, and pump during step 815. During step 820, the user may use one of the pull through technique or the inversion technique to install the resin impregnated liner 415 within the host pipe 405 having at least one annular space sealing apparatus 100 installed therein. The user may then cure the resin impregnated liner 415 within the host pipe 405 during step 825. Once cured, the user may use a pipe inspection crawler 435 to cut a hole into the cured resin impregnated liner 415 at the lateral line connection point 510 to reestablish flow from the lateral line 305 to the sewer system during step 830. After flow has been reestablished, the user may proceed to terminate method step 835.

Although the systems and processes of the present disclosure have been discussed for use within the wastewater management field, one of skill in the art will appreciate that the inventive subject matter disclosed herein may be utilized in other fields or for other applications in which wastewater management is needed. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flow depicted in the accompanying figures and/or described herein do not necessarily require the particular order shown, or sequential order, to achieve desirable results. It will be readily understood to those skilled in the art that various other changes in the details, materials, and arrangements of the parts and process stages which have been described and illustrated in order to explain the nature of this inventive subject matter can be made without departing from the principles and scope of the inventive subject matter.

What is claimed is:

1. A system for reducing infiltrate within a wastewater management system comprising:

a sleeve comprising a flexible sheet having a first end, second end, top, and bottom, wherein an exterior surface of said flexible sheet at said first end is placed in contact with an interior surface of said flexible sheet at said second end in way that creates an inner cavity having a first opening and second opening, wherein said exterior surface is configured to secure to said interior surface, wherein said first opening and said second opening are generally circular in shape, wherein said exterior surface of said flexible sheet is configured to contact an inner wall of a host pipe, wherein a lateral porthole of said flexible sheet extends into said inner cavity, a hydrophilic gasket secured to said exterior surface of said flexible sheet and about said lateral porthole, wherein said hydrophilic gasket is configured to expand when it absorbs water to create a water barrier between said sleeve and said inner wall of said host pipe, and a cured in place pipe distributed through said host pipe and said sleeve, wherein said water barrier reduces an amount of infiltrate freely flowing through a lateral line connection point and into said cured in place pipe.

2. The system of claim 1, wherein said lateral porthole is configured to be placed about a lateral line connection point.

3. The system of claim 2, wherein said lateral porthole is wider than said lateral line connection point.

4. The system of claim 3, wherein said hydrophilic gasket is wider than said lateral porthole.

5. The system of claim 4, wherein said hydrophilic gasket is ring shaped and wherein a central opening of said ring is wider than said lateral porthole.

6. The system of claim 1, further comprising a second hydrophilic gasket about said lateral porthole on said interior surface, wherein said second hydrophilic gasket creates said water barrier between said flexible sheet and a cured in place pipe.

7. The system of claim 6, wherein said second hydrophilic gasket is wider than said lateral porthole.

8. The system of claim 1, further comprising a locking mechanism secured to at least one of said interior surface or said exterior surface, wherein said locking mechanism secures said interior surface to said exterior surface.

9. The system of claim 1, wherein said exterior surface is moveably secured to said interior surface.

10. A method for reducing an amount of infiltrate entering a wastewater management system comprising steps of:

obtaining an annular space sealing apparatus having a sleeve and a hydrophilic gasket, wherein said hydrophilic gasket is secured about a lateral porthole of a flexible sheet of said sleeve, wherein said flexible sheet comprises a first end, second end, top, and bottom, wherein an exterior surface of said flexible sheet at said first end is placed in contact with an interior surface of said flexible sheet at said second end in way that creates an inner cavity having a first opening and second opening, wherein said exterior surface is configured to secure to said interior surface, wherein said first opening and said second opening are generally circular in shape, wherein said exterior surface of said flexible sheet is configured to contact an inner wall of a host pipe, wherein a lateral porthole of said flexible sheet extends into said inner cavity, and, wherein said hydrophilic gasket is configured to expand when it absorbs water to create a water barrier between said sleeve and said inner wall of said host pipe, obtaining a resin impregnated liner, bladder, and pump, attaching said annular space sealing apparatus to said host pipe, wherein said annular space sealing apparatus is secured to said host pipe at a lateral line connection point, wherein said lateral porthole is secured about said lateral line connection point, wherein said hydrophilic gasket creates said water barrier between said flexible sheet and said host pipe to reduce an amount of infiltrate entering a wastewater management system, pulling said resin impregnated liner and said bladder through said host pipe and said annular space sealing apparatus, inflating said bladder using said pump, wherein inflation of said bladder causes said resin impregnated liner to expand within said host pipe until said resin impregnated liner is firmly pressed against an inner wall of said host pipe and said hydrophilic gasket of said annular space sealing apparatus, and curing said resin impregnated liner in a way such that said resin impregnated liner hardens into a new pipe within said host pipe.

11. The method of claim 10, further comprising the steps of:

locating said lateral porthole secured about said lateral line connection point that is situated between said new pipe and said host pipe, and cutting a hole into said new pipe to reestablish flow from a lateral line to said wastewater management system.

12. The method of claim 10, wherein said lateral porthole is configured to be placed about a lateral line connection point.

13. The method of claim 12, wherein said lateral porthole is wider than said lateral line connection point.

14. The method of claim 13, wherein said hydrophilic gasket is wider than said lateral porthole.

15. The method of claim 14, wherein said hydrophilic gasket is ring shaped and wherein a central opening of said hydrophilic gasket is wider than said lateral porthole.

16. The method of claim 10, further comprising a second hydrophilic gasket about said lateral porthole on said interior surface, wherein said second hydrophilic gasket creates said water barrier between said flexible sheet and a cured in place pipe.

17. The method of claim 16, wherein said second hydrophilic gasket is wider than said lateral porthole.

18. The method of claim 10, further comprising the steps of:

obtaining a pipe inspection crawler configured to install said annular space sealing apparatus within a host pipe, wherein said annular space sealing apparatus is secured to said host pipe using said pipe inspection crawler.

19. The method of claim 18, further comprising additional steps of:

inspecting said host pipe using said pipe inspection crawler to determine if said host pipe has a damaged section that requires said resin impregnated liner, wherein said resin impregnated liner will reduce said amount of infiltrate entering said wastewater management system when used in combination with said annular space sealing apparatus.

20. A method for reducing an amount of infiltrate entering a wastewater management system comprising steps of:

obtaining an annular space sealing apparatus having a flexible sheet and a hydrophilic gasket, wherein said hydrophilic gasket is secured about a lateral porthole of said flexible sheet, wherein said flexible sheet comprises a first end, second end, top, and bottom, wherein an exterior surface of said flexible sheet at said first end is removably secured to an interior surface of said flexible sheet at said second end in way that creates an inner cavity having a first opening and second opening, wherein said first opening and said second opening are generally circular in shape, wherein said exterior surface of said flexible sheet is configured to contact an inner wall of a host pipe, wherein a lateral porthole of said flexible sheet extends into said inner cavity, wherein said hydrophilic gasket is configured to expand when it absorbs water to create a water barrier between said flexible sheet and said inner wall of said host pipe, obtaining a pipe inspection crawler configured to install said annular space sealing apparatus within a host pipe, and attaching said annular space sealing apparatus to said host pipe using said pipe inspection crawler, wherein said annular space sealing apparatus is secured to said host pipe at a lateral line connection point, wherein said hydrophilic gasket creates said water barrier between said flexible sheet and said host pipe to reduce an amount of infiltrate entering a wastewater management system.

* * * * *